US007017308B2

(12) United States Patent
Marshall

(10) Patent No.: US 7,017,308 B2
(45) Date of Patent: Mar. 28, 2006

(54) BRICKLAYING TOOL

(76) Inventor: Noel Marshall, Meadstown, Carrigaline, County Cork (IE)

( * ) Notice: Subject to any disclaimer, the term of this patent is extended or adjusted under 35 U.S.C. 154(b) by 0 days.

(21) Appl. No.: 10/639,691

(22) Filed: Aug. 13, 2003

(65) Prior Publication Data

US 2005/0034416 A1 Feb. 17, 2005

Related U.S. Application Data

(63) Continuation-in-part of application No. PCT/IE02/00019, filed on Feb. 12, 2002.

(30) Foreign Application Priority Data

Feb. 13, 2001 (IE) ..... S2001/0116

(51) Int. Cl.
*E05B 1/38* (2006.01)

(52) U.S. Cl. ..... 52/127.5; 52/127.3; 52/749.13; 52/DIG. 1; 249/90

(58) Field of Classification Search ..... 52/127.3, 52/127.5, 749.13, 749.12, DIG. 1; 249/90, 249/83, 84
See application file for complete search history.

(56) References Cited

U.S. PATENT DOCUMENTS

| | | | | |
|---|---|---|---|---|
| 1,690,856 A | | 11/1928 | Clementson | |
| 2,585,283 A | | 2/1952 | Sommers | |
| 2,652,714 A | * | 9/1953 | Sommers | 52/49.14 |
| 3,030,738 A | * | 4/1962 | Brewer et al. | 52/749.13 |
| 3,203,070 A | | 8/1965 | Kolakowski | |
| 4,074,503 A | | 2/1978 | Watt et al. | |
| 4,093,172 A | * | 6/1978 | Johnson | 249/19 |
| 4,709,526 A | | 12/1987 | Crumby | |
| 5,125,814 A | | 6/1992 | Lester | |
| 5,458,169 A | | 10/1995 | Biafore | |

FOREIGN PATENT DOCUMENTS

| | | | |
|---|---|---|---|
| CH | 104029 | | 3/1924 |
| DE | 826638 | | 3/1952 |
| DE | 845705 | | 4/1952 |
| FR | 84907 | | 5/1965 |
| FR | 1530802 | | 6/1968 |
| FR | 2733265 | | 10/1996 |
| FR | 2812676 | * | 2/2002 |
| GB | 1477923 | | 6/1977 |
| GB | 1538803 | | 1/1979 |
| GB | 2131474 | | 6/1984 |
| GB | 2182705 | | 5/1987 |
| GB | 2284008 | | 5/1995 |
| GB | 2300216 | * | 10/1996 |
| GB | 2321271 | | 7/1998 |
| JP | 2004084441 | * | 3/2004 |

* cited by examiner

*Primary Examiner*—Naoko Slack
(74) *Attorney, Agent, or Firm*—Jacobson Holman PLLC

(57) ABSTRACT

A bricklaying tool includes a mortar guide member having a slot for reception of mortar when the tool is placed on a course of bricks when building a wall. The mortar guide member has a brick engagement panel. An upstanding mortar retaining flange is provided having a rear edge of the panel. A spirit level is mounted on the flange. The slot is open ended with a stiffening strut mounted across the open end which also forms a handle.

32 Claims, 17 Drawing Sheets

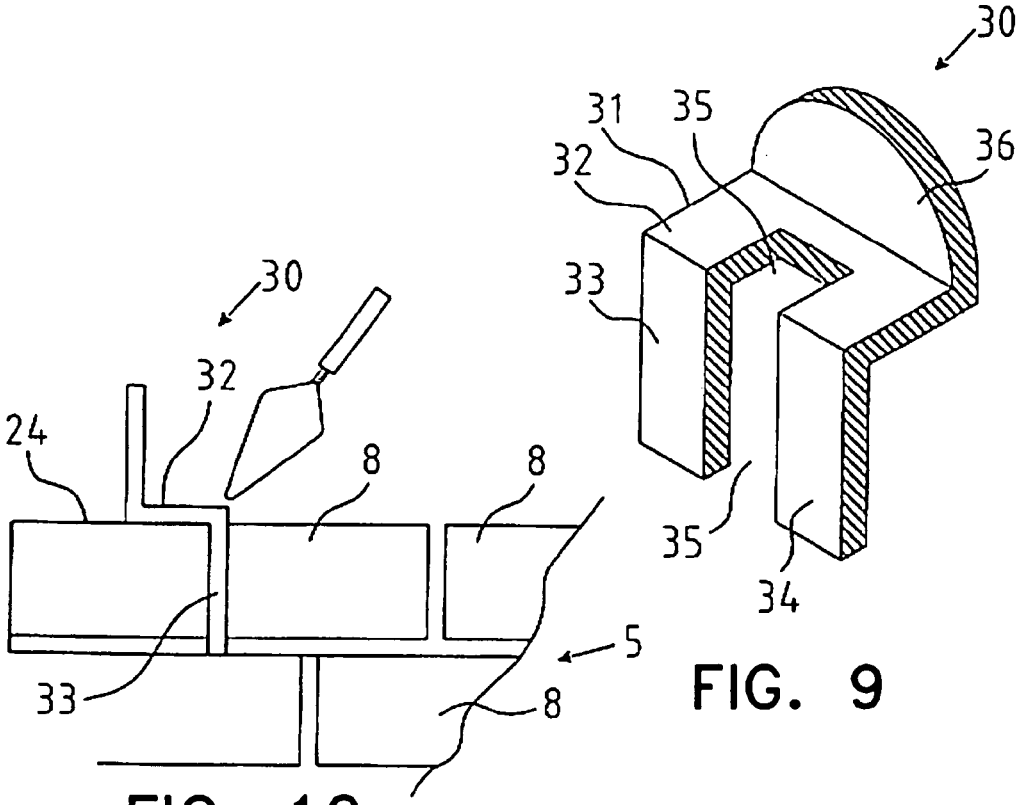
FIG. 9
FIG. 10
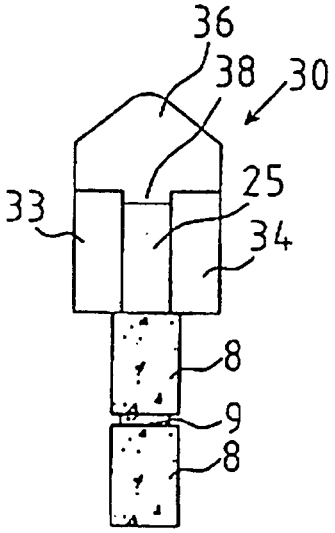
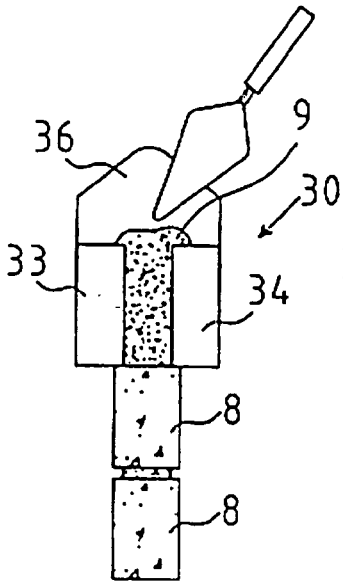
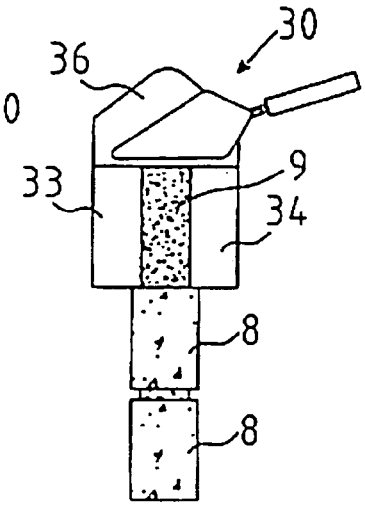
FIG. 11 FIG. 12 FIG. 13

BRICKLAYING TOOL

This is a continuation-in-part of PCT/IE02/00019 filed Feb. 12, 2002 and published in English.

Building a wall from bricks, blocks, stones, or the like building elements is a relatively skilled task. Within this patent specification the term "brick" shall be used generally to refer to all such building elements.

BACKGROUND OF THE INVENTION

A wall is built up from ground level in a number of layers or courses of bricks with the bricklayer spreading a layer of mortar along the top of each course of bricks and placing another course of bricks on the layer of mortar. This application of mortar, usually by means of a trowel, is extremely messy and wasteful. Usually excess mortar falls away on each side of the wall. Furthermore, it is relatively difficult to evenly spread the mortar to retain a level course of bricks and the bricklayer needs to spend time embedding in and levelling each brick on the mortar. Also pointing is required to remove excess mortar and give a finished face to the mortar between the bricks. Therefore there is a considerable wastage of mortar, and time spent in cleaning up the mortar joints during building of the wall and in cleaning up the waste mortar which falls away during the wall building.

A number of bricklaying aids have been previously proposed. For example, British Patent Specification No. 2321271 discloses a bricklaying aid which sits on top of a wall to form a rectangular frame having sides which sit along opposite sides of the wall for applying a measured amount of mortar onto the top of the all between the sides of the frame. British Patent Specification No. 1538803 describes a bricklaying tool for controlling the spread and amount of mortar applied to the joints between bricks. The tool has an L-shaped frame for applying a measured amount of mortar along a top face of a wall and against an end face of a previously laid brick on top of the wall. U.S. Pat. No. 4,709,526 discloses a template for application of mortar onto a top surface of pre-cast hollow concrete blocks which have a pair of voids extending between a top and a bottom of the block. The template is seated on top of the block and has panels which cover the voids and channels for applying a layer of mortar along the top edges of the block side walls, around the void and in the middle of the block top face between the voids. In U.S. Pat. No. 4,074,503 there is disclosed a bricklaying device having a rectangular frame for placing on a previously laid course of bricks to define a trough for forming a layer of mortar on top of the bricks ready to receive the next layer of bricks.

The various prior art devices have not been entirely satisfactory and it is an object of the present invention to provide an improved bricklaying tool which is easy to use, particularly for amateur or DIY builders, and is cheap to manufacture.

SUMMARY OF THE INVENTION

According to the invention there is provided a bricklaying tool for use in laying bricks to form a wall, comprising:

a mortar guide member having a mortar receiving slot, the width of the mortar receiving slot being less than the width of the bricks for constructing said wall;

locating means on the mortar guide member for mounting the mortar guide member on a course of bricks forming portion of the wall;

a mortar receiving pocket formed by the mortar receiving slot and the surface of portion of the wall when the guide member is resting thereon, which pocket is positioned inwardly of opposite side faces of the wall;

a mortar receiving platform comprising a C-shaped brick engagement panel, through which the mortar receiving slot projects, the brick engagement panel having a mortar reservoir platform for receiving and supporting mortar about a periphery of the slot, the platform being provided by an outer and upper, in use, face of the panel and wall engagement means formed by an inner and lower, in use, face of the panel; and an upstanding mortar retaining flange projecting upwardly, in use, from the outer face of the panel and spaced-apart from the mortar receiving slot.

Conveniently, the mortar guide member is engagable with the wall such that the slot co-operates with the wall to allow deposition of a predetermined amount of mortar in a desired orientation on the wall. Mortar is supported on the brick engagement panel ready for filling the mortar receiving slot and is prevented from spilling off by the mortar retaining flange. Thus a layer of mortar can be readily easily and accurately and cleanly formed on the wall ready for reception of the next course of bricks.

The mortar retaining flange may extend along a rear edge of the brick engagement panel. Thus advantageously mortar is prevented from falling down behind the wall as it is being built.

In a particularly preferred embodiment, the mortar retaining flange extends along a rear edge and along a side edge of the brick engagement panel.

In a further embodiment, the bricklaying tool includes a level indicating means. The level indicating means may be formed by a spirit level. Conveniently, the level indicating means may be mounted on the mortar retaining flange and may be used for indicating both a longitudinal and a transverse level of the mortar guide member. For example, a spirit level may be mounted on a first portion of the mortar retaining flange at a rear edge of the brick engagement panel and on a second portion of the mortar retaining flange at the side edge of the brick engagement panel.

In a further embodiment, the locating means comprises one or more outwardly extending locator elements on a wall engaging face of the mortar guide member at one or both sides of the slot for engagement with side faces of bricks in the wall against which the mortar guide member is mounted. The locating means may comprise two pairs of spaced-apart lugs on a wall engaging face of the mortar guide member on each side of the mortar receiving slot for engagement with both side faces of the bricks in the wall against which the mortar guide is mounted.

In a further embodiment, the locating means is operable to position each side of the slot 10 mm inwardly from side faces of the bricks with which the mortar guide member is engaged in use.

Conveniently, a hand grip may be provided on the mortar guide member.

In a particularly preferred embodiment, the mortar guide member has an elongate brick engagement panel with a mortar receiving slot extending through the panel, an upstanding flange extending upwardly from a top of the panel along one side of the panel, and locator lugs projecting downwardly from a bottom of the panel at opposite sides of the mortar receiving slot.

Conveniently, the mortar receiving slot is open at one end. Ideally, a stiffening strip or strut is mounted above the open end of the slot between panel portions at opposite sides of the slot. The stiffening strut may comprise a pair of arms which project upwardly from the panel at opposite sides of the slot. The arms are then interconnected by a cross member.

A handle may conveniently be mounted on the flange.

In a further embodiment, an upstanding flange is provided extending upwardly from the top panel remote from the legs. A handle may be mounted on the flange.

In another embodiment of the invention, the mortar guide member is cranked intermediate it's ends, having an upper portion for seating engagement with a top surface of a brick and a lower portion extending perpendicularly downwardly from the upper portion for engagement with an end face of a brick.

In another aspect the invention provides a bricklaying tool for use in laying bricks to form a wall, which includes a mortar guide member having a slot for reception of mortar, the width of the slot being less than the width of the bricks for constructing said wall, the mortar guide member having locating means for mounting the mortar guide member on a course of bricks forming portion of the wall with the slot defining with a surface of said wall portion a mortar receiving pocket at said surface which is positioned inwardly of the said side faces of the wall, said locating means comprising at least one pair of spring-loaded locator elements. Preferably two spaced-apart pairs of spring-loaded locator elements are mounted on an underside of the mortar guide member.

In a further aspect the invention provides a bricklaying kit comprising a first bricklaying tool for applying mortar to a top surface of bricks in a wall during construction of the wall and a second brick laying tool for applying mortar to a vertical end face of bricks in a wall during construction of the wall, one or both of said first bricklaying tool and said second bricklaying tool being of a type described herein.

In a still further aspect, there is provided a bricklaying kit comprising a first horizontal bricklaying tool for laying a horizontal course of mortar on bricks when constructing a wall and a second vertical bricklaying tool for forming vertical courses of mortar between adjacent vertical end faces of bricks in the wall. The horizontal bricklaying tool may be as previously described and the vertical bricklaying tool may be the bricklaying tool previously described with the cranked mortar guide member. Alternatively, the vertical bricklaying tool may comprise a mortar guide member having a slot for reception of mortar, the width of the slot being less than the width of the bricks for constructing the wall, the mortar guide member having locating means for mounting the mortar guide member against an upright end wall of a brick with the mortar receiving slot defining with a surface of said brick end wall, a mortar receiving pocket at said surface which is positioned inwardly of opposite side faces of the brick.

BRIEF DESCRIPTION OF THE DRAWINGS

The invention will be more clearly understood by the following description of some embodiments thereof, given by way of example only, with reference to the accompanying drawings in which:

FIG. 9 is a perspective view of another bricklaying tool according to the invention;

FIG. 10 is an elevational view showing the bricklaying tool of FIG. 9 in use;

FIG. 11 is an end elevational view showing the bricklaying tool of FIG. 9, in use;

FIG. 12 is a view similar to FIG. 11 showing a further step, in use, of the bricklaying tool of FIG. 9;

FIG. 13 is a view similar to FIG. 11 showing a further step, in use, of the bricklaying tool of FIG. 9 in wall construction;

DETAILED DESCRIPTION OF THE PREFERRED EMBODIMENTS

Figure 3:
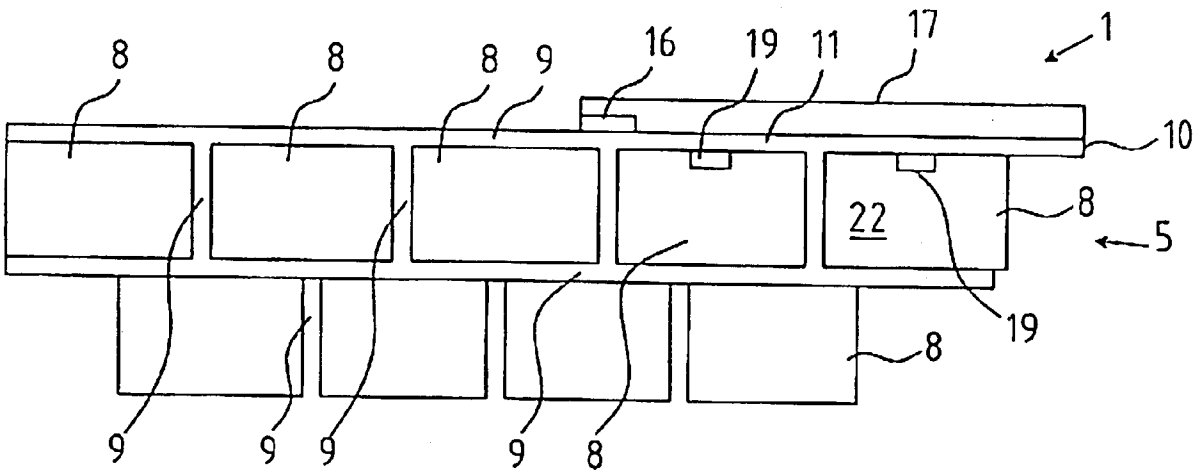
FIG. 3 is an elevational view showing the bricklaying tool, in use, in wall construction.
Figure 4:
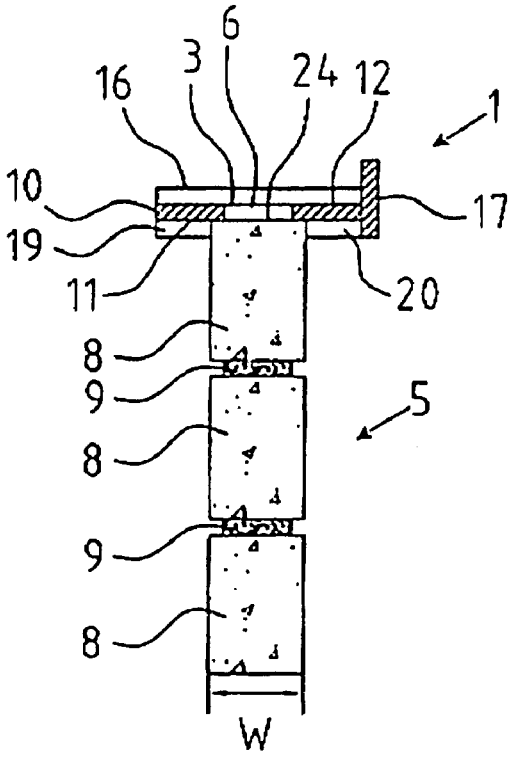
FIG. 4 is a partially sectioned end elevational view showing the bricklaying tool mounted on a wall, in use.

Referring to the drawings, and initially to FIGS. 1 to 8 thereof, there is illustrated a bricklaying tool according to the invention, indicated generally by the reference numeral 1. The tool 1 includes a mortar guide member 2 having a slot 3 for reception of mortar such that when the tool 1 is mounted on a wall 5 as shown in FIG. 3, the mortar receiving slot 3 defines with a top face of the wall 5 a mortar receiving pocket 6 (FIG. 4) on the wall 5. The pocket 6 is obviously only formed in use.

The wall 5 comprises a number of superimposed courses of bricks 8 with mortar 9 therebetween.

Figure 1:
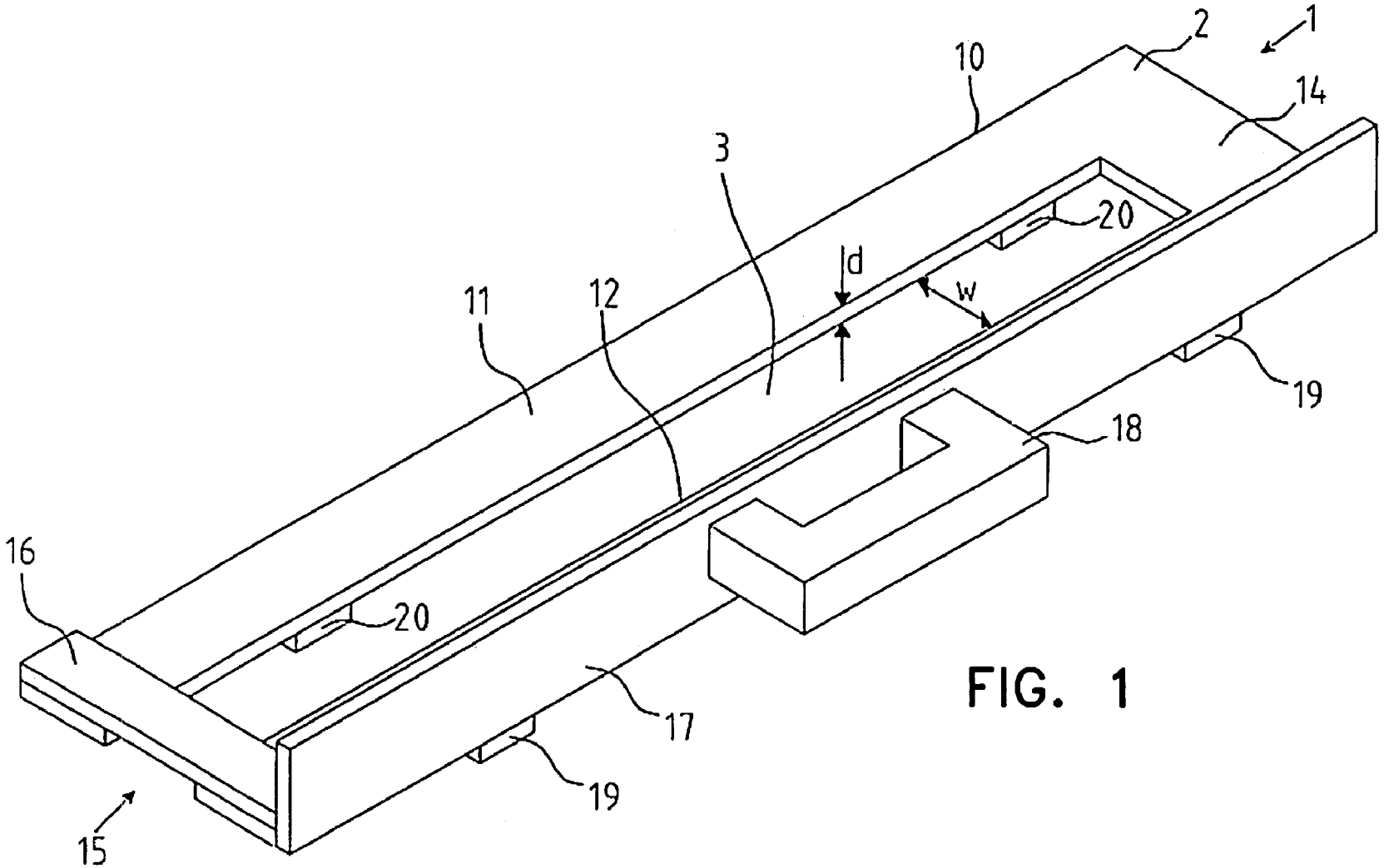
FIG. 1 is a perspective view of a bricklaying tool according to the invention.
Figure 2:
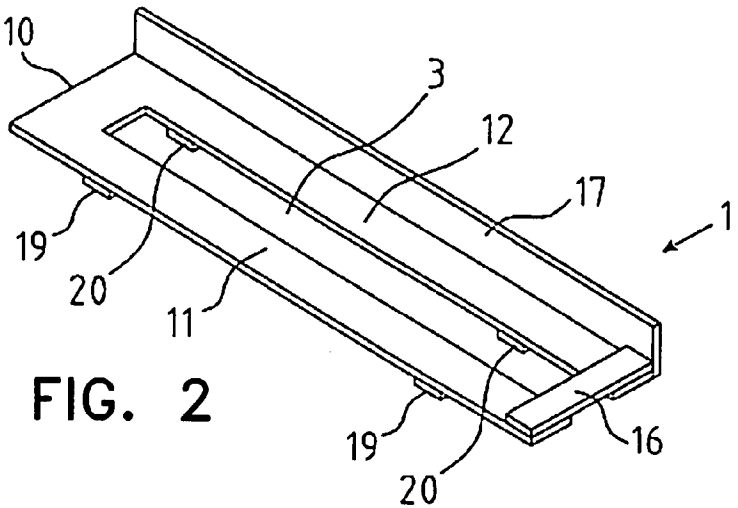
FIG. 2 is another perspective view of the bricklaying tool, shown from an opposite side of the tool.

The mortar guide member 2 essentially comprises a mortar receiving platform comprising a C-shaped brick engagement panel 10 having a pair of spaced-apart side elements 11, 12 interconnected at one end by an end element 14 to define the slot 3. As can be seen in FIG. 1, the mortar receiving slot 3 is open at an opposite end 15 to the end element 14 with the side elements 11, 12 being rigidly supported by a stiffening strut 16 bridging across the open end 15 of the slot 3 above the slot 3 and securely fastened to free ends of the side elements 11, 12. An upstanding mortar retaining flange 17 is provided along one side edge of the panel 10 and extends upwardly from a top of the panel. A handle 18 is mounted on an outside face of the flange 17. It will be noted that the depth d of the panel 10 at the slot 3 sides is chosen to correspond to the required depth of mortar to be laid on the wall 5. Similarly, the width w of the slot 3 is chosen to correspond to the particular bricks 8 being used to form the wall 5 and is somewhat less than the width W (FIG. 4) of such bricks 8.

Pairs of locating lugs 19, 20 are provided on an underside of each side element 11, 12 of the panel 10 for engagement with opposite side faces 22, 23 of bricks 8 to centrally position the slot 3 along the top faces 24 of the uppermost course of bricks 8 in the wall 5.

Figure 5:
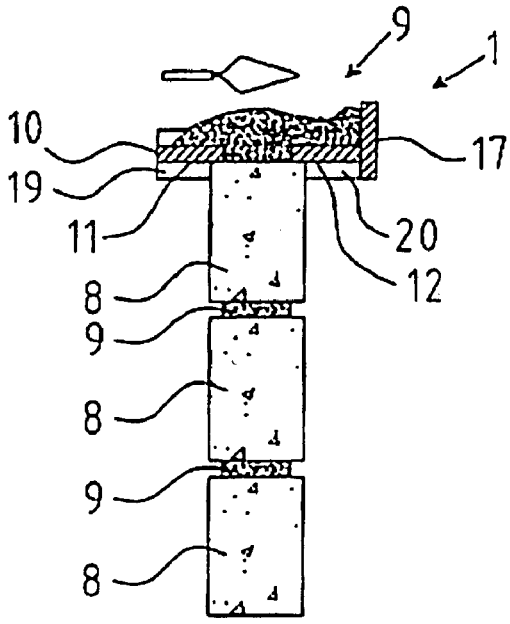
FIG. 5 is a view similar to FIG. 4 showing another step, in use, of the bricklaying tool.
Figure 6:
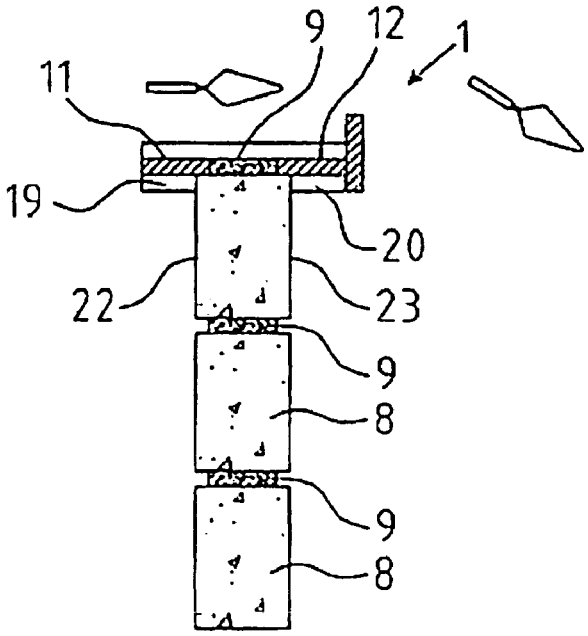
FIG. 6 is a view similar to FIG. 4 showing a further step, in use, of the bricklaying tool.
Figure 7:
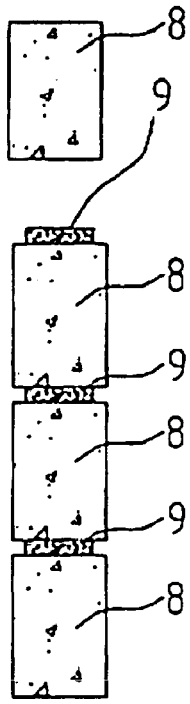
FIG. 7 is a partially exploded end elevational view showing the mounting of a brick on a mortar course formed by the bricklaying tool.
Figure 8:
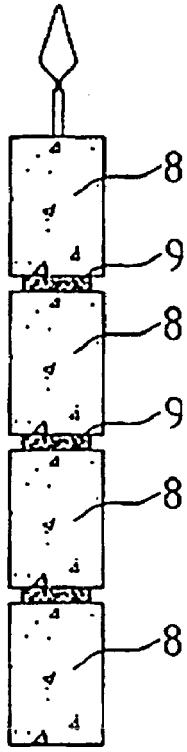
FIG. 8 is a view similar to FIG. 7 showing the positioning of the brick on the mortar course formed by the bricklaying tool.

FIGS. 4 to 8 show the sequence for using the bricklaying tool to lay a course of bricks 8 on the wall 5. As can be seen, the tool 1 is seated astride the uppermost course of bricks 8 with a bottom face of the panel 10 seated against the top face 24 of the brick 8 with the locators 19, 20 centrally positioning the slot 3 along the top faces 24 of the bricks 8 to form the mortar receiving pocket 6. This bottom or inner and lower, in use, face of the panel forms a wall engagement means. As shown in FIG. 5, a quantity of mortar 9 is positioned on top of the platform 10 which essentially forms a tray for the mortar 9 and with a trowel, the mortar 9 is worked into the pocket 6 to fill the pocket 6, as shown in FIG. 6. The tray is in effect a mortar reservoir platform which is provided by the outer and upper, in use, face of the panel. Thus, a layer of mortar 9 of a desired depth is laid upon the uppermost course of bricks 8 in the wall 5. Upon removal of the tool 1, as shown in FIG. 7, a brick 8 can then be placed on the mortar 9 and lightly tapped into position, as shown in FIG. 8. It will be noted that because the sides of the inner edges of the side elements 11, 12 of the panel 10 project inwardly from the outer side faces 22, 23 of the brick 8, no cleaning or pointing of the mortar 9 is required and there is no wastage of mortar in forming the layer of mortar on the bricks 8.

Referring now to FIGS. 9 to 13, there is shown another bricklaying tool 30 according to another embodiment of the invention. In this case, the tool 30 is for neatly forming the mortar between end faces of bricks 8 in the wall 5. The tool 30 has a mortar guide member 31 of cranked configuration including a top panel 32 with a pair of spaced-apart downwardly extending legs 33, 34 defining therebetween a mortar receiving slot 35. As shown in the drawings, the mortar receiving slot 35 extends partially across the top panel 32. An upstanding flange 36 is provided extending upwardly from a side of the top panel 32 remote from the legs 33, 34.

In use, the tool 30 is mounted at one end of a brick 8 with the top panel 32 seated on the top face 24 of the brick and the legs 33, 34 extending downwardly along an end face 25 of the brick 8. The next brick 8 is then placed on the wall 5 abutting the free faces of the legs 33, 34 so that the pair of bricks 8 and the tool 30 define therebetween a pocket 38, open at the top, for reception of mortar 9 which is dropped into the pocket 38 from above to form a neat joint between the two bricks 8, as illustrated in FIGS. 12 and 13. Upon removal of the tool 30, a mortar joint is left between the two bricks 8 in a finished state without the need for cleaning up or pointing between the bricks 8.

Figure 14:
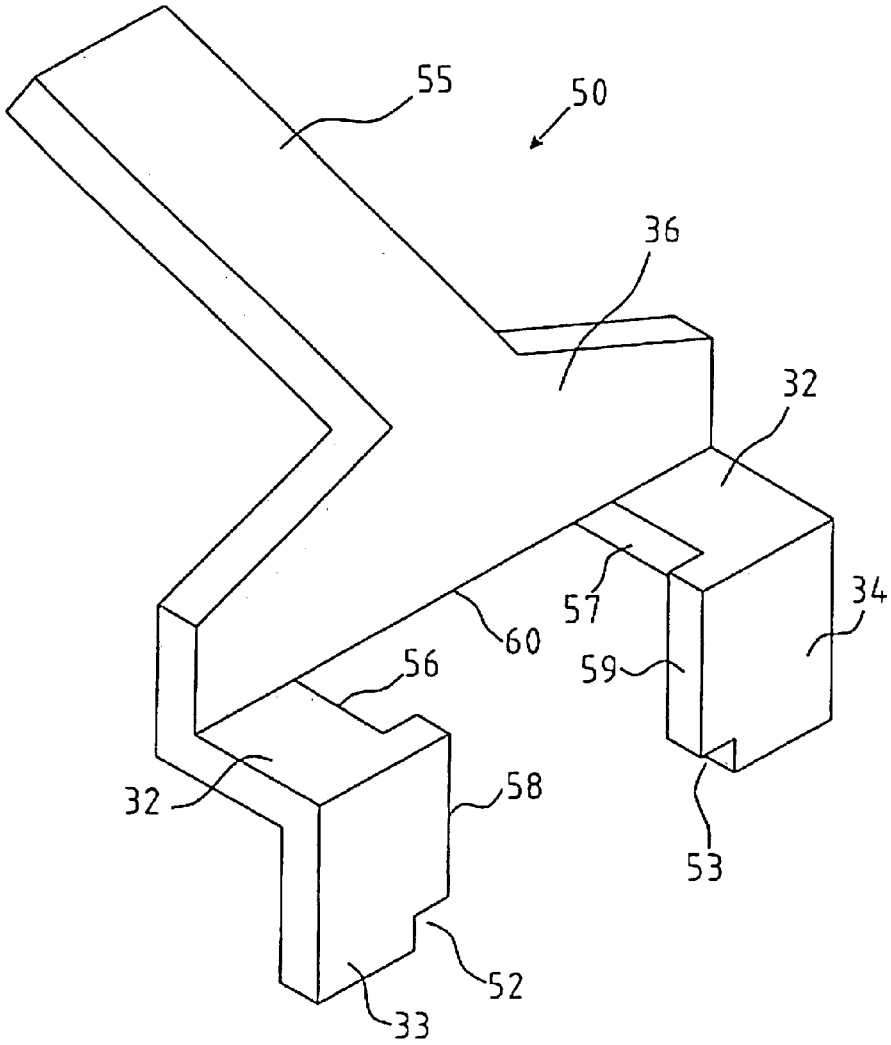
FIG. 14 is a perspective view of a further bricklaying tool according to the invention.
Figure 15:
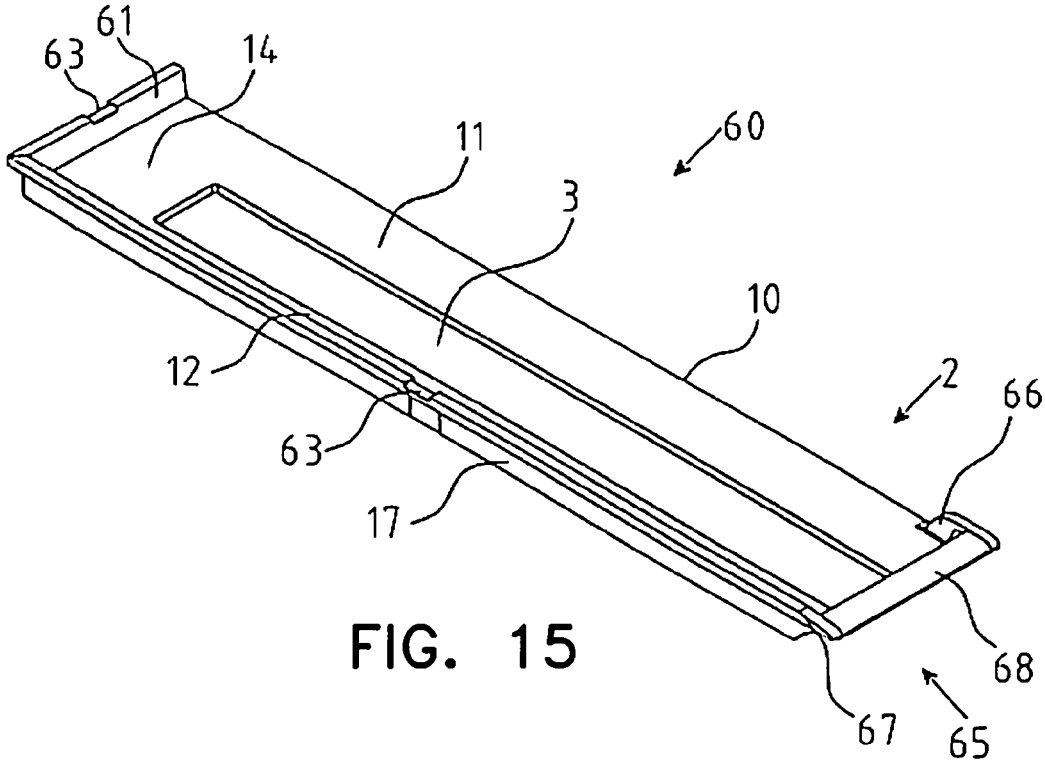
FIG. 15 is a perspective view of another bricklaying tool according to another embodiment of the invention.
Figure 16:
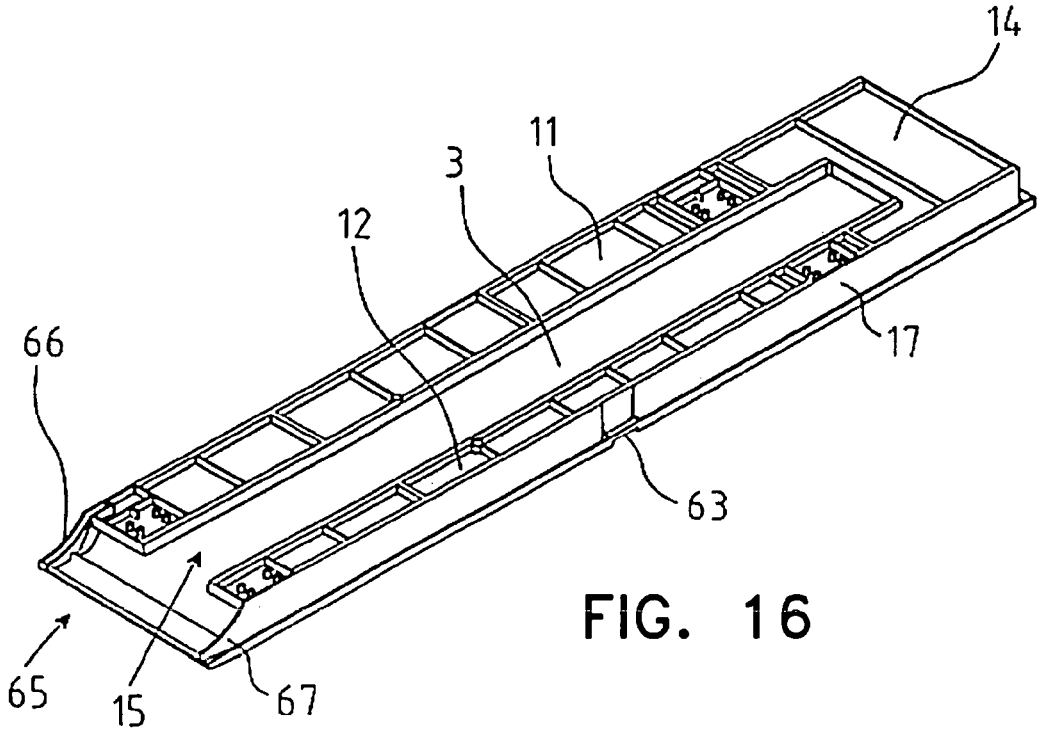
FIG. 16 is an underneath perspective view of the bricklaying tool shown in FIG. 15.

Referring to FIG. 14, there is shown another bricklaying tool, indicated generally by the reference numeral 50. This is largely similar to the tool shown in FIG. 9 and like parts are assigned the same reference numerals. In this case, the legs 33, 34 have stepped inner edges 52, 53 for location with side edges of a brick 8 below the brick 8 on which the tool 50 is seated. Also, a handle 55 is mounted on the flange 36. The top panel 32 is cut away in the centre with the flange 36 forming a bridge between opposite sides of the top panel 32. Inside faces 56, 57 of each side portion of the top panel 32 are engagable against opposite side faces of a brick 8 and a lower edge 60 of the flange 36 between the panel 32 side portions seats on the top face 24 of a brick 8 when the tool 50 is mounted thereon to properly locate the tool 50 on the brick 8 in the desired orientation. It will be noted that the legs 33, 34 have inner sides 58, 59 which project inwardly of the top panel portions 32 to provide the recessed mortar joint between adjacent bricks in use.

Referring now to FIGS. 15 to 27, there is illustrated another bricklaying tool according to another embodiment of the invention, indicated generally by the reference numeral 60. This is largely similar to the bricklaying tool described previously with reference to FIGS. 1 to 8, and like parts are assigned the same reference numerals. In this case, an additional mortar retaining flange 61 is provided along an end of the brick engagement panel 10 extending forwardly from the rear mortar retaining flange 17. Level indicators 63 formed by spirit levels are mounted midway along each of the mortar retaining flanges 17, 61 at an upper edge of each of said flanges 17, 61 to indicate both a longitudinal and a transverse level of the mortar guide member 2.

It will be noted that the front side element 11 is of greater width than the rear side element 12 projecting forwardly from the slot 3, and in use the wall, to provide a mortar reservoir platform together with the rear side element 12 and end element 14.

In this case a stiffening strut 65 is mounted across the open end 15 of the slot 3. The stiffening strut 65 comprises a pair of arms 66, 67 which project upwardly and outwardly from the side elements 11, 12 of the brick engagement panel 10 at opposite sides of the slot 3. A cross member 68 forming a handle interconnects outer ends of the arms 66, 67.

Figure 23:
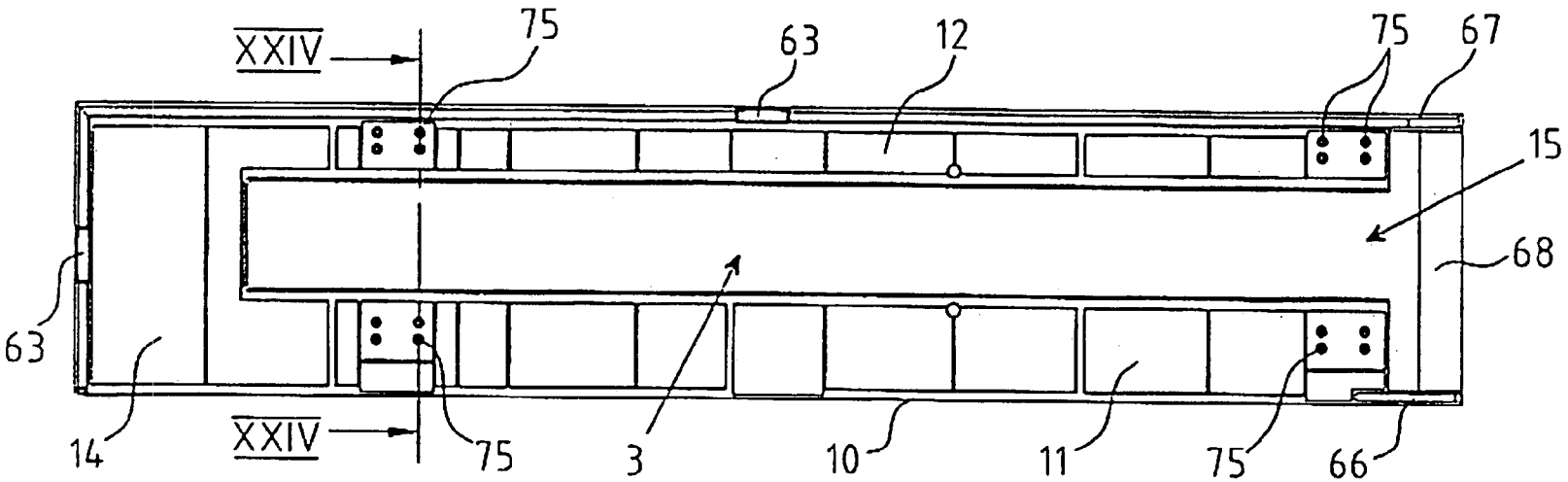
FIG. 23 is an underneath plan view of the bricklaying tool of FIG. 15.
Figure 27:
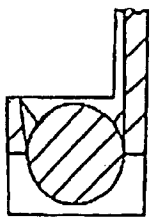
FIG. 27 is a detail sectional view showing a level indicating vial mount arrangement of the bricklaying tool of FIG. 15.
Figure 26:
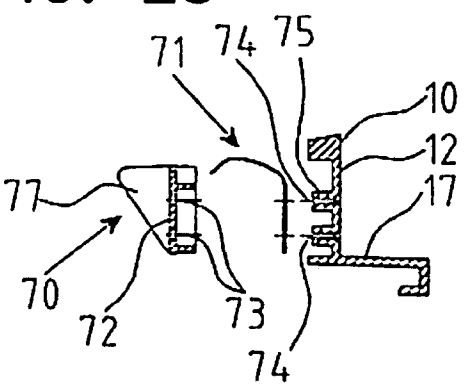
FIG. 26 is an exploded detail view of the mounting spring arrangement shown in FIG. 25.
Figure 25:
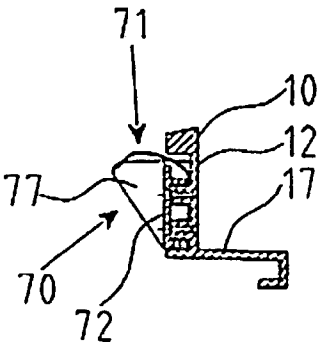
FIG. 25 is a detail sectional view showing a mounting spring arrangement of the bricklaying tool of FIG. 15.
Figure 24:
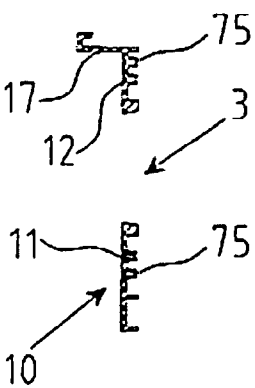
FIG. 24 is a sectional view taken along the line XXIV—XXIV of FIG. 23.
Figure 28:
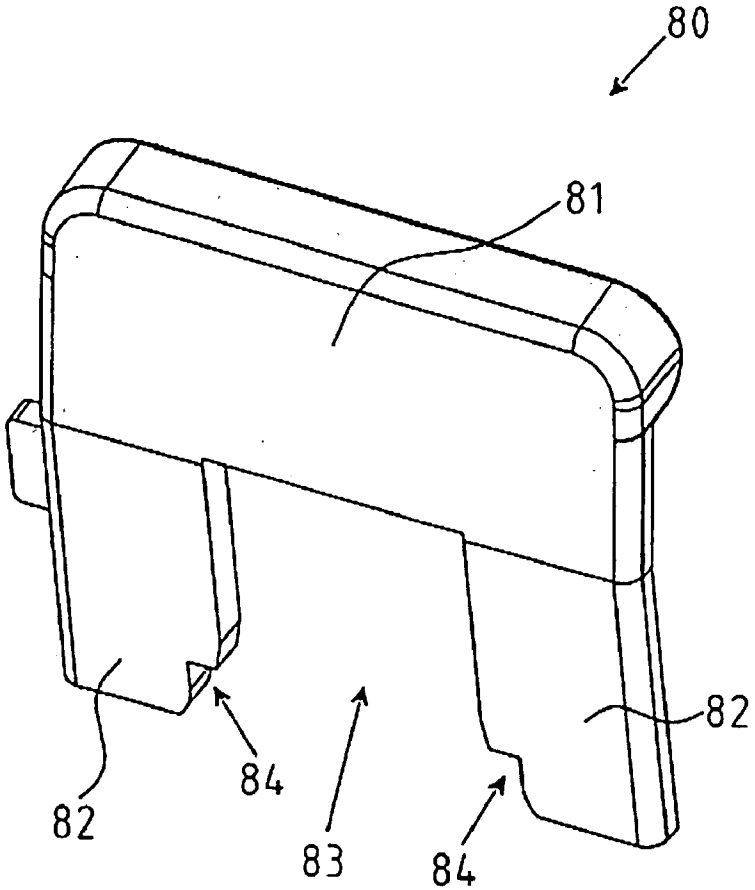
FIG. 28 is a perspective view of another bricklaying tool.
Figure 29:
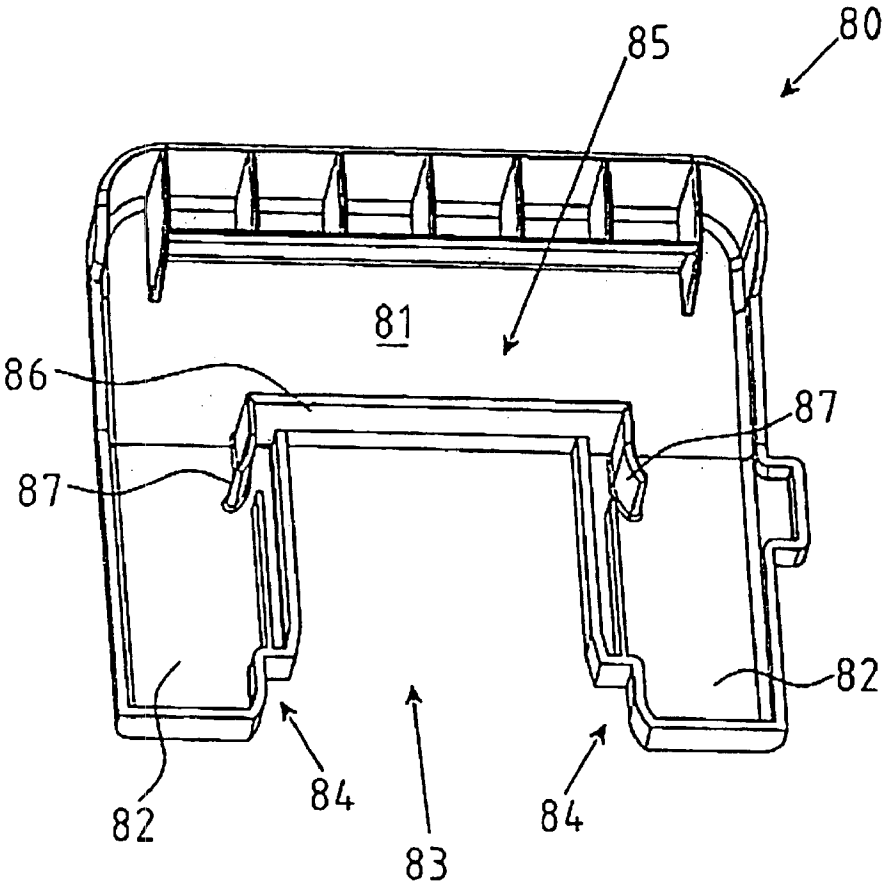
FIG. 29 is a rear perspective view of the bricklaying tool of FIG. 28.
Figure 30:
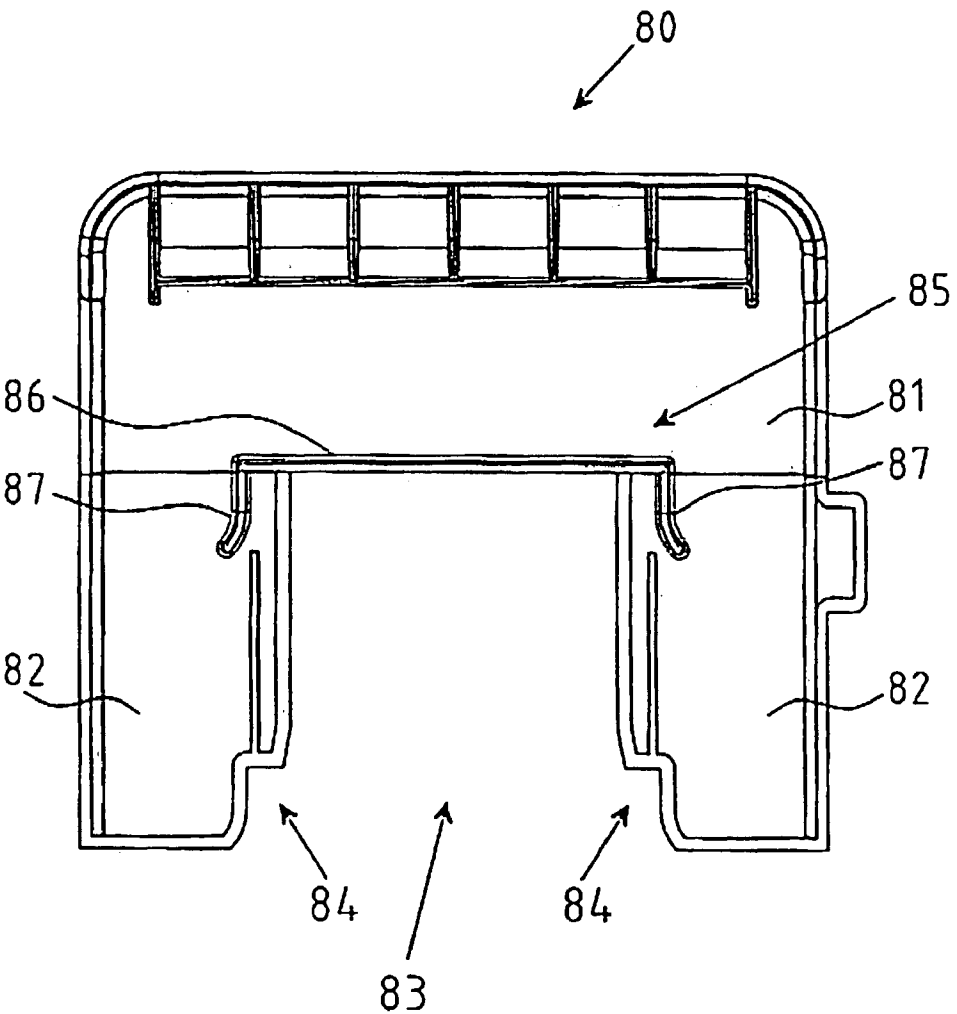
FIG. 30 is a rear elevational view of the bricklaying tool of FIG. 28.
Figure 32:
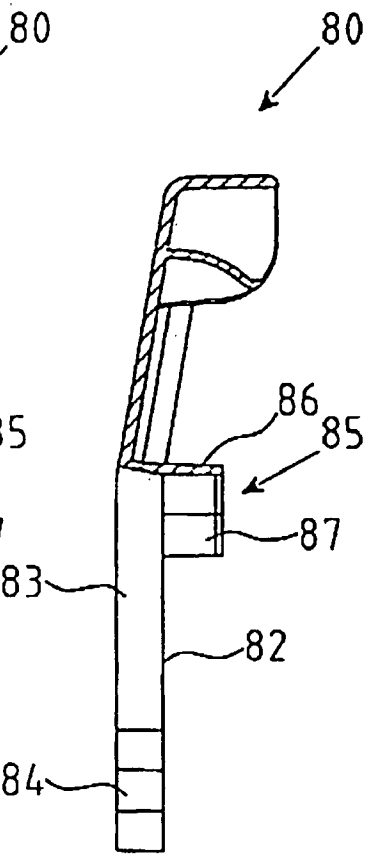
FIG. 32 is a side-sectional elevational view of the bricklaying tool of FIG. 28.
Figure 31:
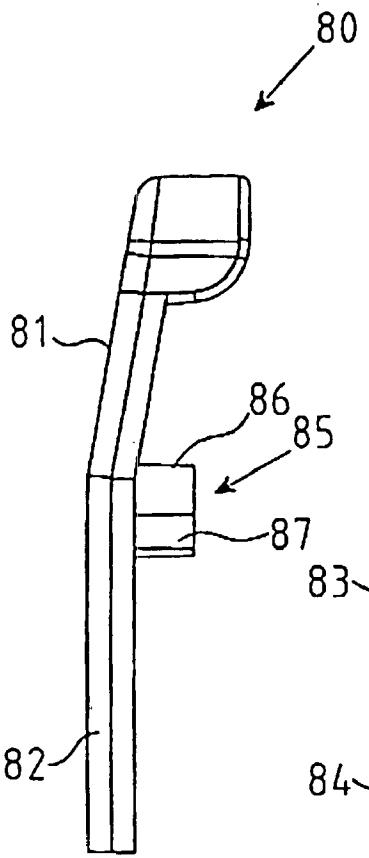
FIG. 31 is a side-elevational view of the bricklaying tool of FIG. 28.
Figure 34:
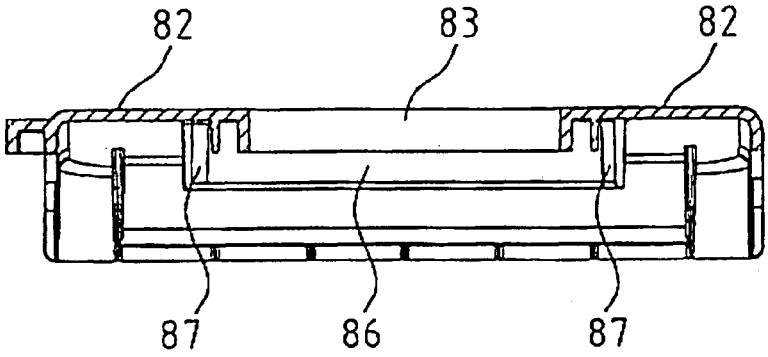
FIG. 34 is a sectional view of the bricklaying tool of FIG. 28, taken along the line XXXIV—XXXIV of FIG. 33.
Figure 33:
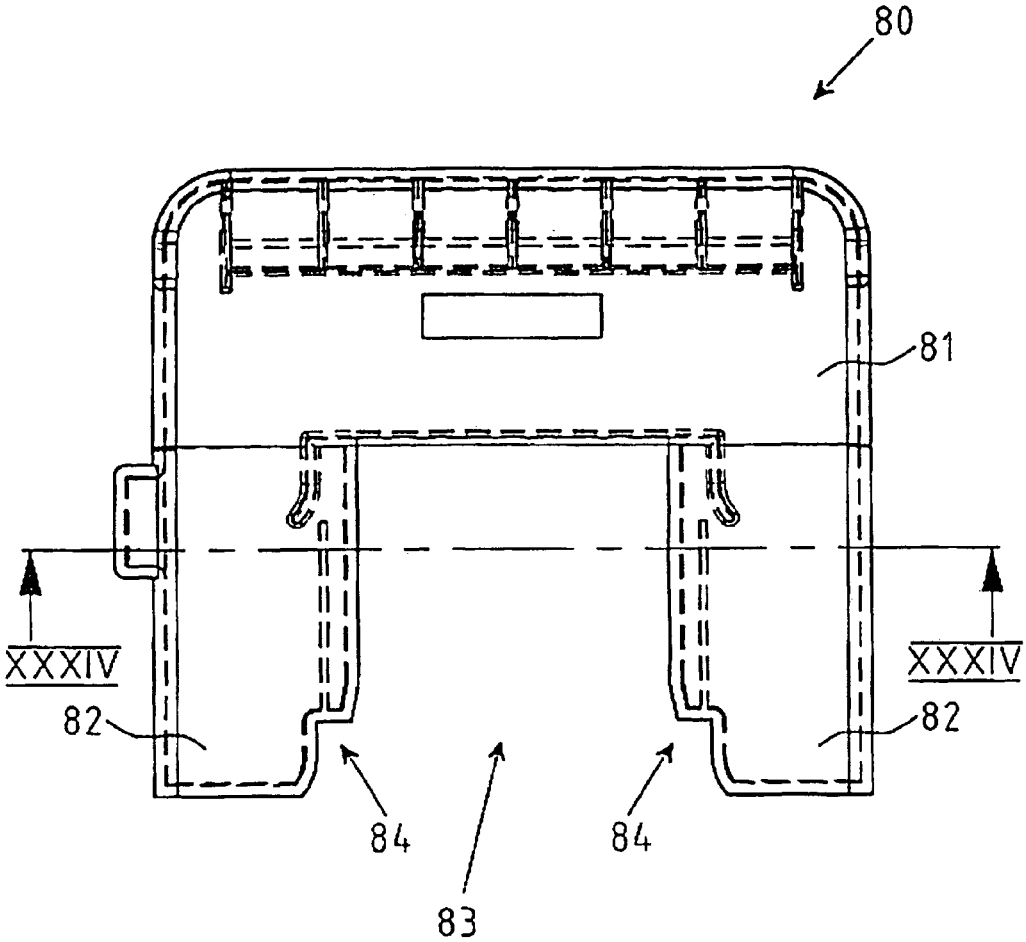
FIG. 33 is a front-elevational view of the bricklaying tool of FIG. 28.
Figure 35:
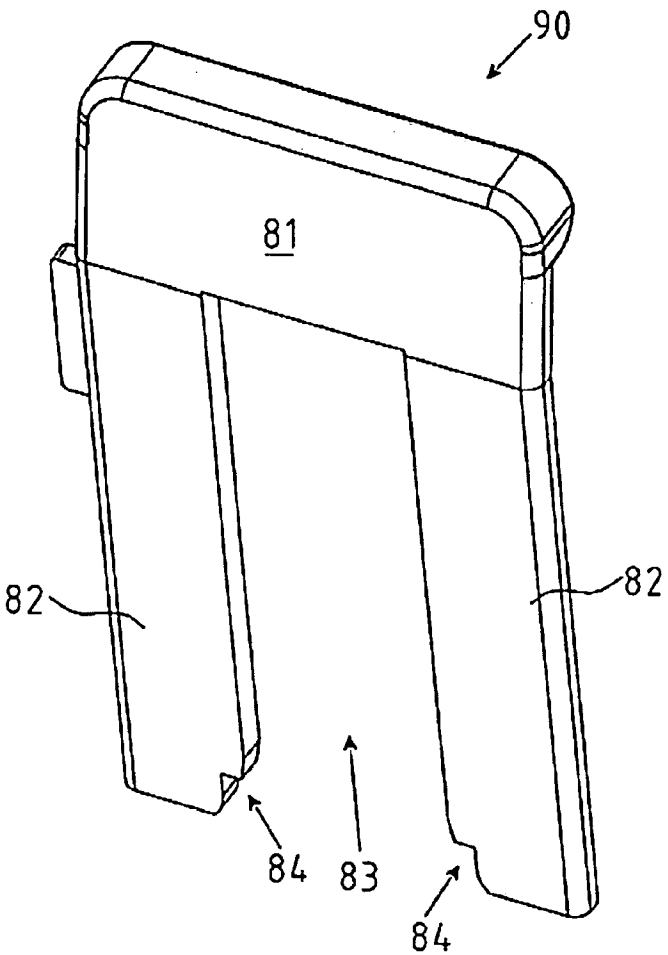
FIG. 35 is a perspective view of another bricklaying tool.
Figure 36:
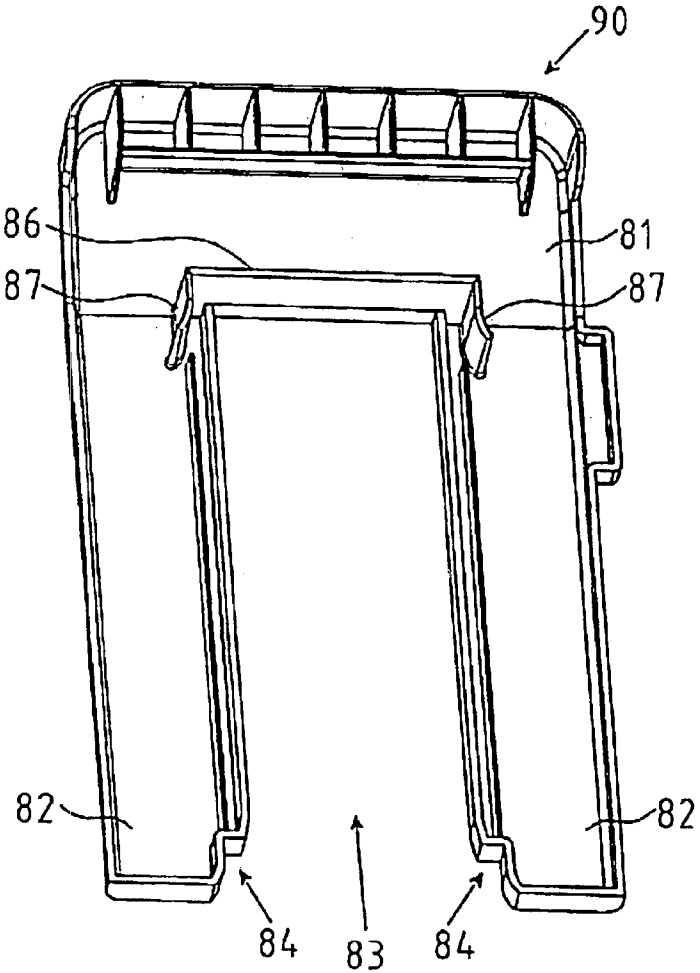
FIG. 36 is a rear perspective view of the bricklaying tool of FIG. 35.
Figure 37:
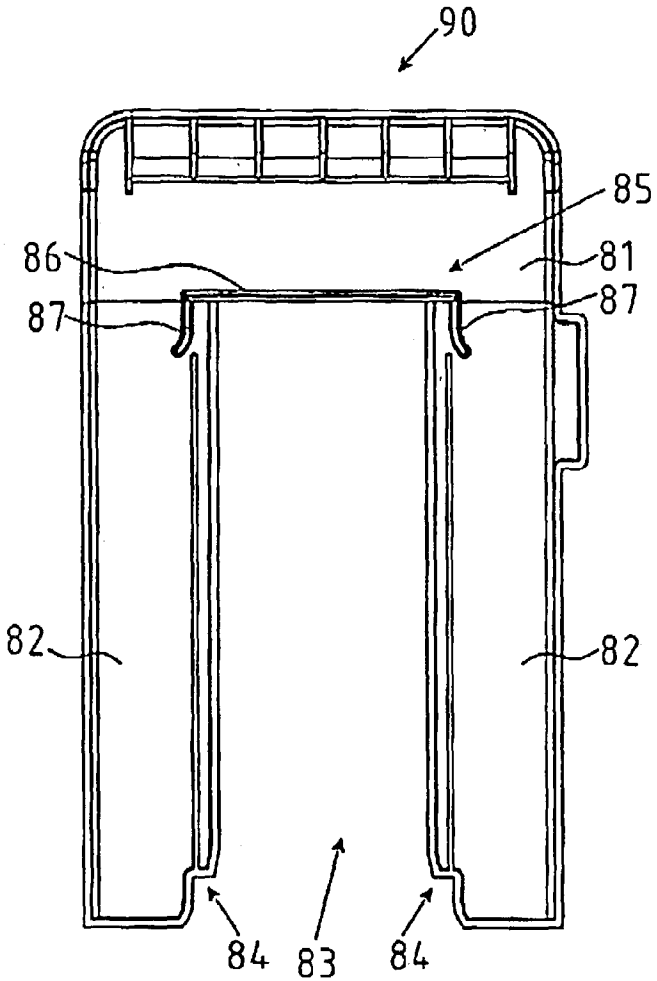
FIG. 37 is a rear elevational view of the bricklaying tool of FIG. 35.
Figure 39:
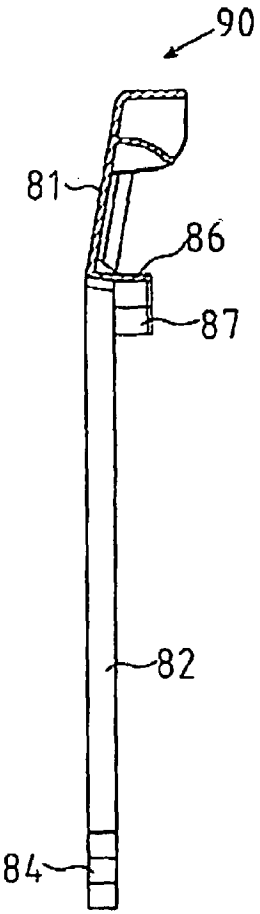
FIG. 39 is a side-sectional elevational view of the bricklaying tool of FIG. 35.
Figure 38:
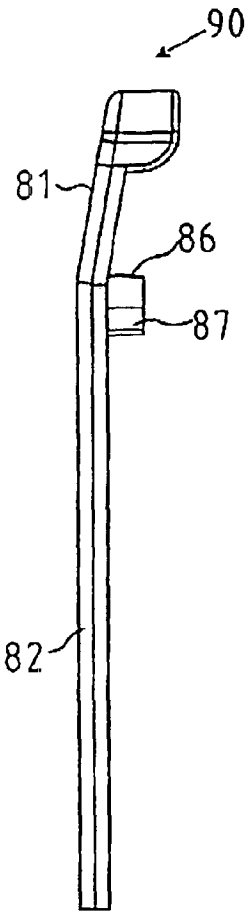
FIG. 38 is a side-elevational view of the bricklaying tool of FIG. 35.
Figure 41:
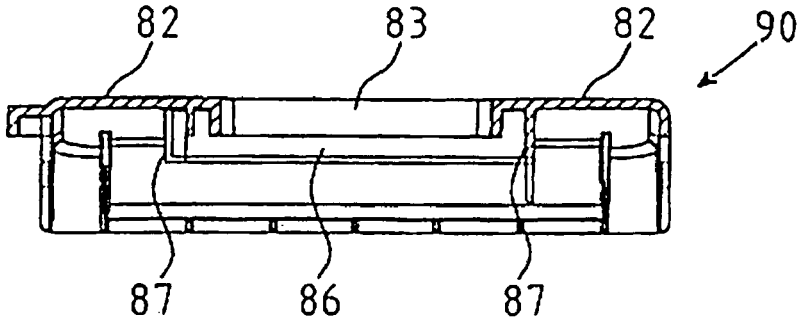
FIG. 41 is a sectional view of the bricklaying tool of FIG. 35, taken along the line XLI—XLI of FIG. 40.
Figure 40:
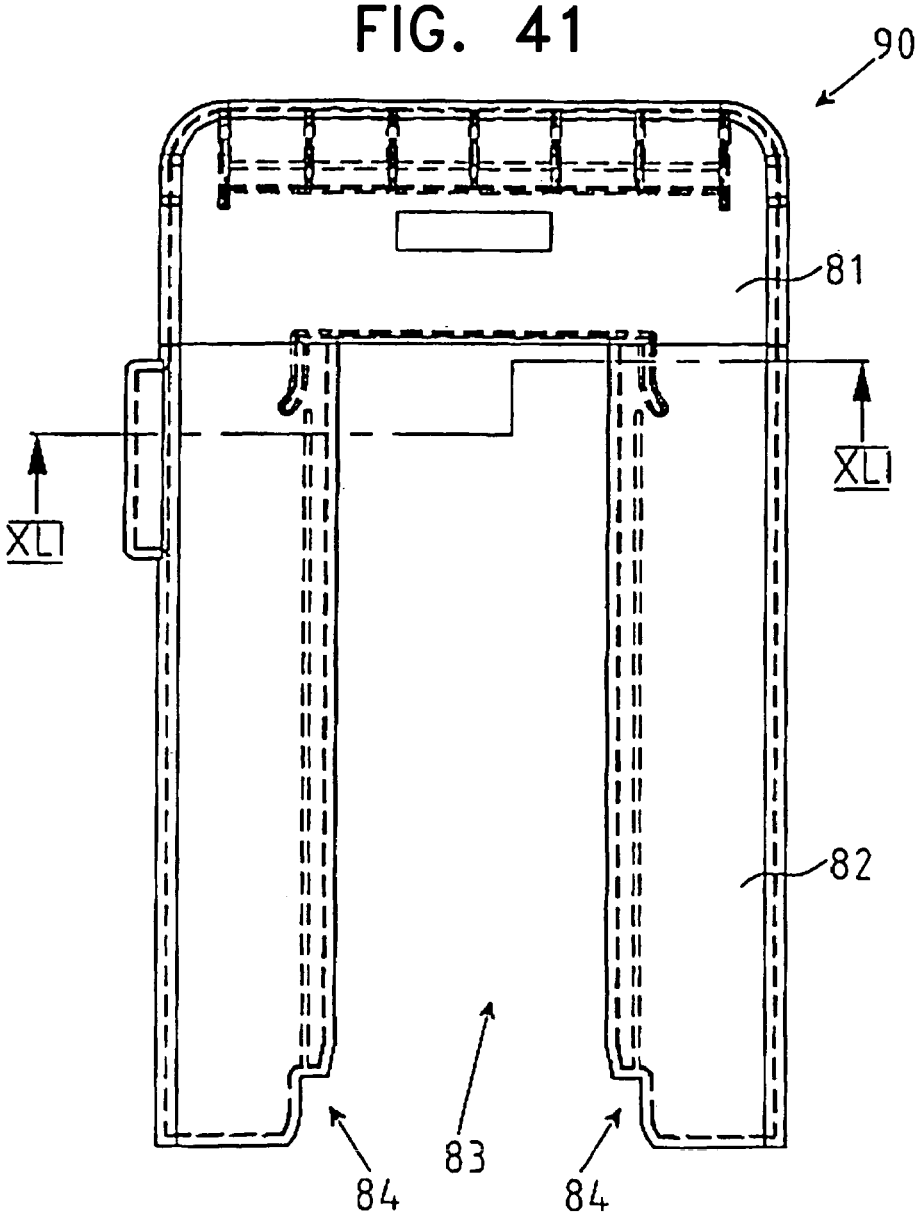
FIG. 40 is a front-elevational view of the bricklaying tool of FIG. 35.

Two spaced-apart pairs of spring loaded locator elements 70 (best seen in FIGS. 25 and 26) are mounted on an underside of the brick engagement panel 10 at opposite sides of the slot 3. Each locator element 70 has a spring plate 71 which is J-shaped in cross section which is clamped on an underside of the brick engagement panel 10 by a retaining bracket 72. Fasteners such as self tapping screws engage through holes 73 in the retaining bracket 72 with associated sockets 74 in mounting posts 75 which project outwardly from an underside of the brick engagement panel 10. Sets of mounting posts 75 are provided on an underside of each side element 11, 12 at opposite ends of the slot 3 as shown in FIG. 23. Holes in the spring 71 allow it to be mounted over the mounting posts 75 and the spring 71 is then retained clamped against an underside of the brick engagement panel 10 by the retaining bracket 72. Flanges 77 on the retaining bracket 72 form a rough guide for location of the brick engagement panel 10 with a course of bricks and prevent over-extension of the spring 71. The springs 71 of the locator elements 70 centre and clamp the brick engagement panel 10 at the top surface of a course of bricks and resiliently clamp the brick engagement panel 10 in engagement with opposite side faces of bricks.

Figures 17, 18, 19, 20, 21, 22:
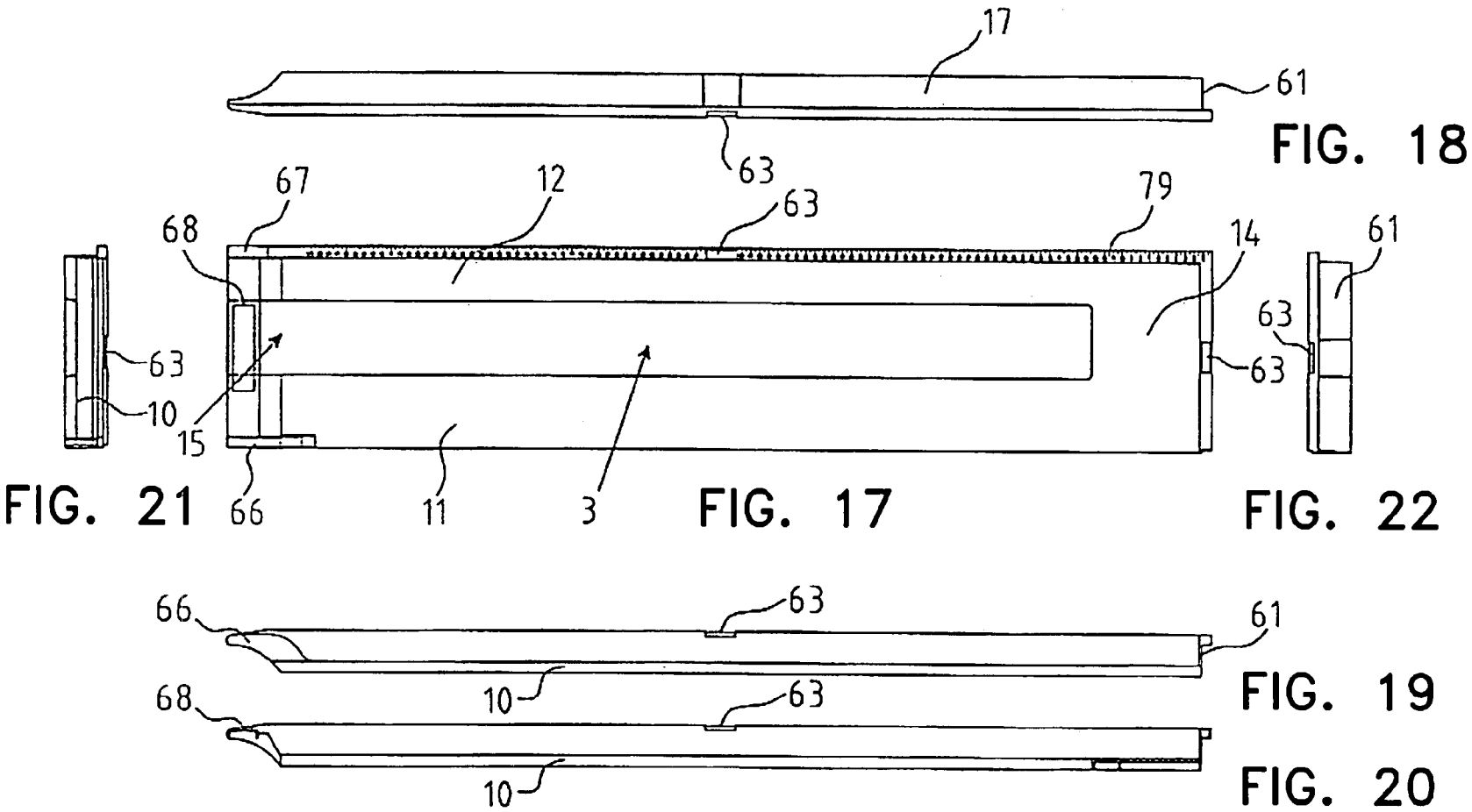
FIG. 17 is a plan view of the bricklaying tool shown in FIG. 15.
FIG. 18 is a side-elevational view of the bricklaying tool of FIG. 15.
FIG. 19 is another side-elevational view of the bricklaying tool of FIG. 15.
FIG. 20 is a side-sectional elevational view of the bricklaying tool of FIG. 15.
FIG. 21 is an end-elevational view of the bricklaying tool of FIG. 15.
FIG. 22 is another end-elevational view of the bricklaying tool of FIG. 15.

A ruler 79 is provided along the top of the rear mortar retaining flange 17 as can be seen in FIG. 17

Referring now to FIG. 28 to 34, there is illustrated another bricklaying tool which in this case comprises a vertical mortar guide member indicated generally by the reference numeral 80. This shows an alternative construction to the tool described with reference to FIG. 9 for forming a vertical course of mortar between vertical end faces of adjacent bricks. The mortar guide member 80 is of moulded plastics construction has an upper panel 81 with a pair of spaced-apart downwardly extended legs 82 defining a slot 83 therebetween for reception of mortar. The width of the slot 83 is less than the width of the bricks for constructing the wall. A step 84 at a lower inside corner of each leg 82 engage with upper edges of a lower course of bricks. At a rear of the mortar guide member 80 a mounting locator 85 has a cross piece 86 which extends across a top of the slot 83 with downwardly depending arms 87 with outwardly flared lower ends. The cross piece 86 and arms 87 project rearwardly so that the cross piece 86 seats on a top face of an upper course of bricks and the arms 87 engage side faces of the brick with the rear of the mortar guide member engaged against an exposed vertical end face of the brick to define a mortar receiving pocket between the slot 83 and the upright end face of the brick.

Referring now to FIGS. 35 to 41, there is illustrated another mortar guide member indicated generally by the reference numeral 90. This is largely similar to the mortar guide member described previously with reference to FIGS. 28 to 34 and to like parts are assigned the same reference numerals. Essentially, the only difference is the fact that the legs 82 are more elongated as the mortar guide member 90 is for use with blocks rather than bricks.

Figure 44:
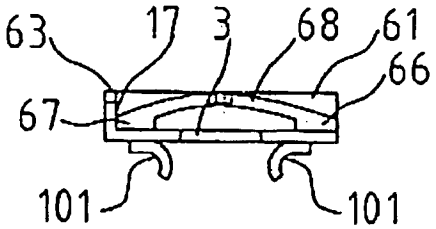
FIG. 44 is an end-elevational view of the bricklaying tool of FIG. 42.
Figure 42:
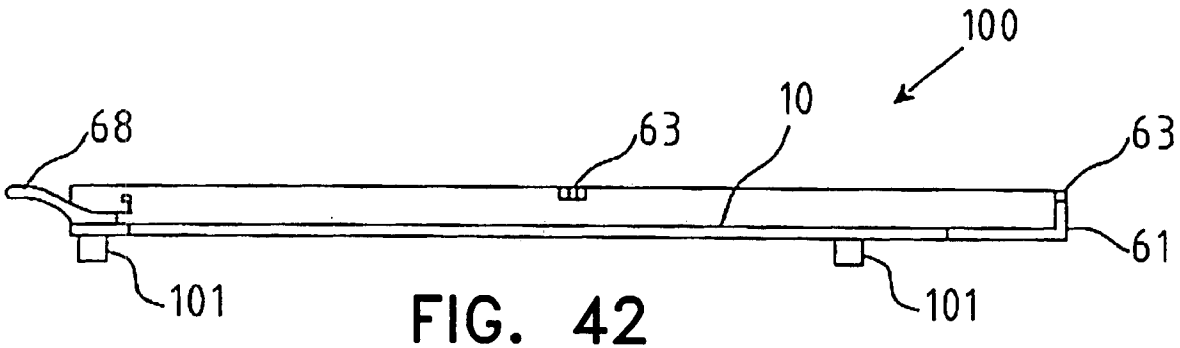
FIG. 42 is an elevational view of a further bricklaying tool.
Figure 43:
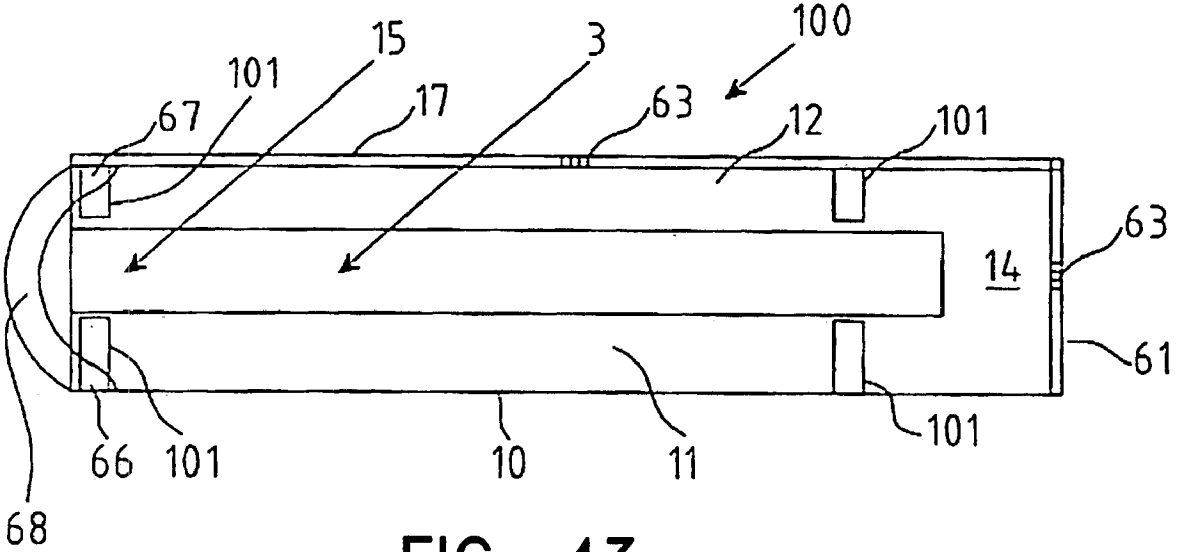
FIG. 43 is a plan view of the bricklaying tool of FIG. 42.
Figure 45:
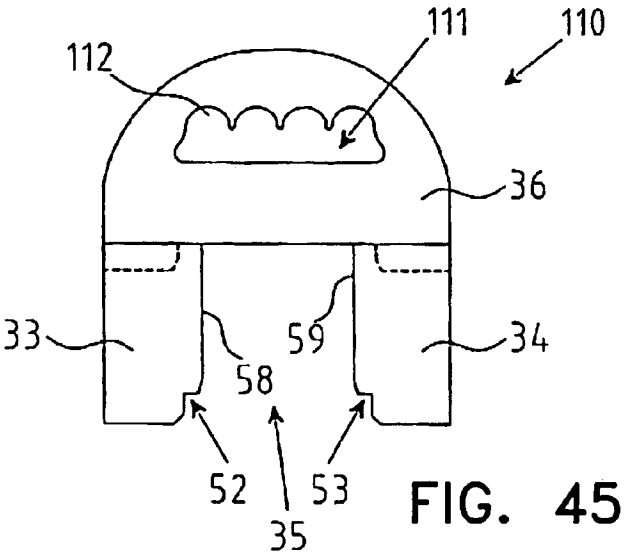
FIG. 45 is an elevational view of a further bricklaying tool.
Figure 46:
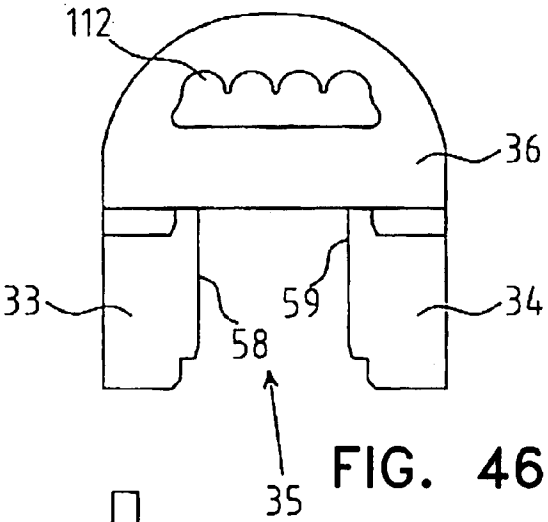
FIG. 46 is a rear elevational view of the bricklaying tool of FIG. 45.
Figure 47:
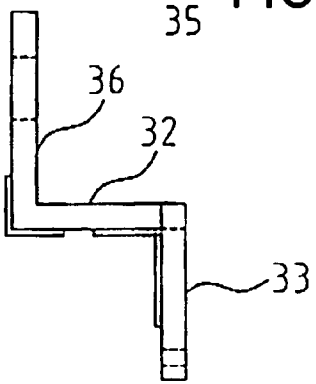
FIG. 47 is an end-elevational view of the bricklaying tool of FIG. 45.
Figure 48:
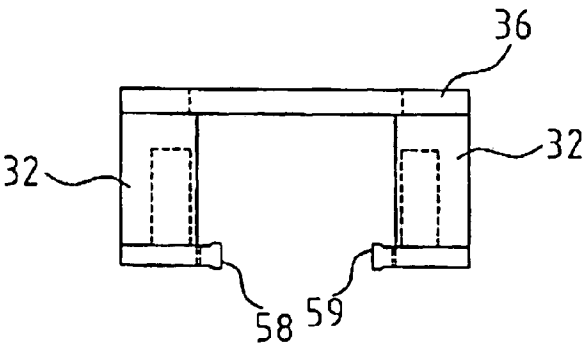
FIG. 48 is a plan view of the bricklaying tool of FIG. 45.
Figure 51:
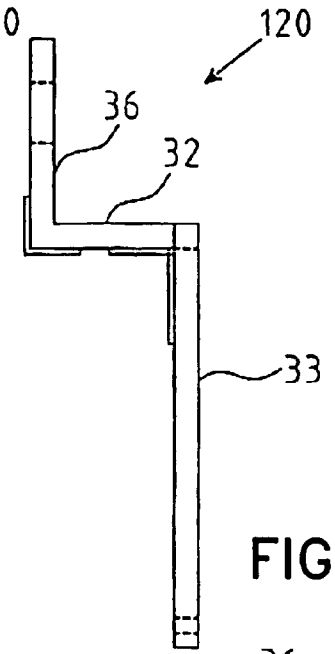
FIG. 51 is an end-elevational view of the bricklaying tool of FIG. 49.
Figure 49:
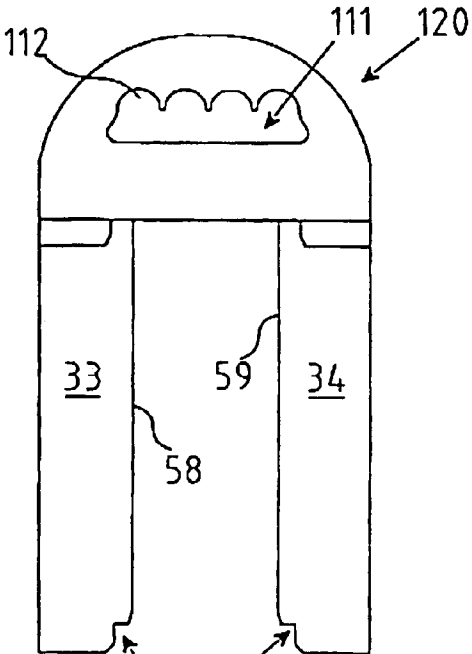
FIG. 49 is a front elevational view of another bricklaying tool.
Figure 50:
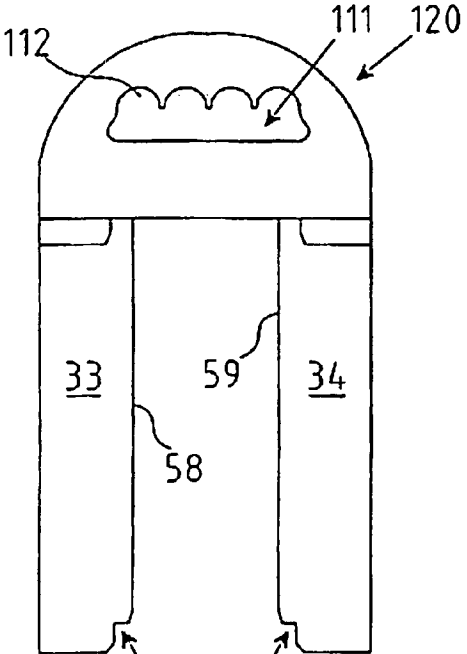
FIG. 50 is a rear elevational view of the bricklaying tool of FIG. 49.
Figure 52:
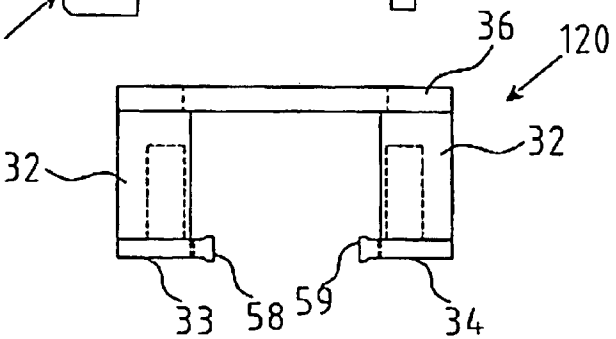
FIG. 52 is a plan view of the bricklaying tool of FIG. 49.

Referring now to FIGS. 42 to 44 there is shown another bricklaying tool indicated generally by the reference numeral 100. This is largely similar to the bricklaying tool described previously with reference to FIGS. 15 to 27 and like parts are assigned the same reference numerals. In this case, two spaced-apart pairs of spring loaded locator elements 101 are provided on an underside of the brick engagement panel 10 to position and hold the bricklaying tool 100 on a wall in use. The locator elements 101 are curved flexible lugs or flaps that can flex to accommodate a variation in the width of bricks and securely resiliently clamp the bricklaying tool 100 on the wall during use.

Referring now to FIGS. 45 to 48 there is illustrated another bricklaying tool indicated generally by the reference numeral 110. This is largely similar to the bricklaying tool shown in FIG. 14 and like parts are assigned the same reference numerals. In this case the flange 36 has an opening 111 to provide a handle in the flange 36 with scalloped finger grips 112.

Referring now to FIGS. 49 to 52 there is shown another bricklaying tool indicated generally by the reference numeral 120. This is largely similar to the bricklaying tool previously described with reference to FIGS. 45 to 48 and like parts are assigned the same reference numerals. Essentially the only difference is that the legs 33, 34 have been elongated as the tool 120 is for use with blocks rather than bricks.

The invention advantageously provides a bricklaying tool which facilitates the application of mortar to a wall during construction of the wall in an accurate, efficient, repeatable and non-wasteful manner. Uniform layers of mortar can be readily, easily and quickly applied on top of a course of bricks for reception of the next course of bricks or in end joints between bricks in each course.

Further, the need for pointing is eliminated or at least minimised, with neat joints between bricks being achieved by use of the bricklaying tool. Also there is no wastage of mortar as arises in conventional building techniques.

In the specification the terms "comprise, comprises, comprised and comprising" or any variation thereof and the terms "include, includes, included and including" or any variation thereof are considered to be totally interchangeable and they should all be afforded the widest possible interpretation and vice versa.

The invention is not limited to the embodiments hereinbefore described which may be varied in both construction and detail within the scope of the appended claims.

What is claimed is:

1. A bricklaying tool for use in laying bricks to form a wall, comprising:

a mortar guide member having a mortar receiving slot, the width of the mortar receiving slot being less than the width of the bricks for constructing said wall;

locating means on the mortar guide member for mounting the mortar guide member on a course of bricks forming portion of the wall;

a mortar receiving pocket formed by the mortar receiving slot and the surface of portion of the wall when the guide member is resting thereon, which pocket is positioned inwardly of opposite side faces of the wall;

a mortar receiving platform comprising a C-shaped brick engagement panel, through which the mortar receiving slot projects, the brick engagement panel having a mortar reservoir platform for receiving and supporting mortar about a periphery of the slot, the platform being provided by an outer and upper, in use, face of the panel and wall engagement means formed by an inner and lower, in use, face of the panel; and an upstanding mortar retaining flange projecting upwardly, in use, from the outer face of the panel and spaced-apart from the mortar receiving slot.

2. A bricklaying tool as claimed in claim 1 wherein the mortar retaining flange extends along a rear edge of the brick engagement panel.

3. A bricklaying tool as claimed in claim 1 wherein the mortar retaining flange extends along a rear edge and along a side edge of the brick engagement panel.

4. A bricklaying tool as claimed in claim 1, comprising a level indicating means.

5. A bricklaying tool as claimed in claim 1, comprising a spirit level.

6. A bricklaying tool as claimed in claim 1, comprising a spirit level mounted on the mortar retaining flange.

7. A bricklaying tool as claimed in claim 1, comprising a level indicating means for indicating both a longitudinal and a transverse level of the mortar guide member.

8. A bricklaying tool as claimed in claim 1, comprising a spirit level on a first portion of the mortar retaining flange at the rear edge of the brick engagement panel and a spirit level on a second portion of the mortar retaining flange at the side edge of the brick engagement panel.

9. A bricklaying tool as claimed in claim 1, wherein the locating means comprises one or more outwardly extending locator elements on a wall engaging face of the mortar guide member at one or both sides of the slot for engagement with side faces of bricks in the wall against which the mortar guide member is mounted.

10. A bricklaying tool as claimed in claim 1, wherein the locating means comprises two pairs of spaced-apart lugs on a wall engaging face of the mortar guide member on each side of the mortar receiving slot for engagement with both side faces of the bricks in the wall against which the mortar guide is mounted.

11. A bricklaying tool as claimed in claim 1, wherein the locating means comprises two spaced-apart pairs of spring loaded locator elements mounted on an underside of the brick engagement panel, each pair of locator elements for engagement with opposite side faces of a brick when the panel is mounted on top of said brick, said locator elements being resiliently moveable apart for clamping engagement with the opposite side faces of the brick.

12. A bricklaying tool as claimed in claim 1, wherein the mortar receiving slot is open at one end.

13. A bricklaying tool as claimed in claim 1, wherein the mortar receiving slot is open at one end of the panel and a stiffening strut is mounted across the open end of the slot above the slot between opposite sides of the panel.

14. A bricklaying tool as claimed in claim 1, wherein the mortar receiving slot is open at one end of the panel and a stiffening strut is mounted across the open end of the slot above the slot between opposite sides of the panel, the stiffening strut comprising a pair of arms which project upwardly from the panel at opposite sides of the slot, said arms being interconnected by a cross member.

15. A bricklaying tool as claimed in claim 1, wherein the mortar guide member is cranked intermediate it's ends having an upper portion for seating engagement with a top surface of a brick and a lower portion extending perpendicularly downwardly from the upper portion for engagement with an end face of a brick.

16. A bricklaying tool for use in laying bricks to form a wall, comprising:

a mortar guide member cranked intermediate it's ends having an upper portion for seating engagement with a top surface of a brick and a lower portion extending perpendicularly downwardly from the upper portion for engagement with an end face of a brick, and having a mortar receiving slot, the width of the mortar receiving slot being less than the width of the bricks for constructing said wall;

locating means on the mortar guide member for mounting the mortar guide member on a course of bricks forming portion of the wall;

a mortar receiving pocket formed by the mortar receiving slot and the surface of portion of the wall when the guide member is resting thereon, which pocket is positioned inwardly of opposite side faces of the wall;

a mortar receiving platform comprising a C-shaped brick engagement panel, through which the mortar receiving slot projects, the brick engagement panel having a mortar reservoir platform for receiving and supporting mortar about a periphery of the slot, the platform being provided by an outer and upper, in use, face of the panel and wall engagement means formed by an inner and lower, in use, face of the panel; and an upstanding mortar retaining flange projecting upwardly, in use, from the outer face of the panel and spaced-apart from the mortar receiving slot.

17. A bricklaying tool as claimed in claim 16, wherein the mortar retaining flange extends along a side edge of the brick engagement panel.

18. A bricklaying tool as claimed in claim 16, wherein the mortar retaining flange extends along a rear edge and along a side edge of the brick engagement panel.

19. A bricklaying tool as claimed in claim 16, comprising a level indicating means for indicating both a longitudinal and a transverse level of the mortar guide member.

20. A bricklaying tool as claimed in claim 16, comprising a spirit level on a first portion of the mortar retaining flange at the rear edge of the brick engagement panel and a spirit level on a second portion of the mortar retaining flange at the side edge of the brick engagement panel.

21. A bricklaying tool as claimed in claim 16, wherein the locating means comprises two spaced-apart pairs of spring loaded locator elements mounted on an underside of the brick engagement panel, each pair of locator elements for engagement with opposite side faces of a brick when the panel is mounted on top of said brick, said locator elements being resiliently moveable apart for clamping engagement with the opposite side faces of the brick.

22. A bricklaying tool as claimed in claim 16, wherein the mortar receiving slot is open at one end.

23. A bricklaying tool as claimed in claim 16, wherein the mortar receiving slot is open at one end of the panel and a stiffening strut is mounted across the open end of the slot above the slot between opposite sides of the panel.

24. A bricklaying tool as claimed in claim 16, wherein the mortar receiving slot is open at one end of the panel and a stiffening strut is mounted across the open end of the slot above the slot between opposite sides of the panel, the stiffening strut comprising a pair of arms which project upwardly from the panel at opposite sides of the slot, said arms being interconnected by a cross member.

25. A bricklaying tool for use in laying bricks to form a wall, comprising:

a mortar guide member having a mortar receiving slot open at one end, the width of the mortar receiving slot being less than the width of the bricks for constructing said wall;

locating means on the mortar guide member for mounting the mortar guide member on a course of bricks forming portion of the wall;

a mortar receiving pocket formed by the mortar receiving slot and the surface of portion of the wall when the guide member is resting thereon, which pocket is positioned inwardly of opposite side faces of the wall;

a mortar receiving platform comprising a C-shaped brick engagement panel, through which the mortar receiving slot projects, the brick engagement panel having a mortar reservoir platform for receiving and supporting mortar about a periphery of the slot, the platform being provided by an outer and upper, in use, face of the panel and wall engagement means formed by an inner and lower, in use, face of the panel;

an upstanding mortar retaining flange projecting upwardly, in use, from the outer face of the panel and spaced-apart from the mortar receiving slot; and a stiffening strut mounted across the open end of the slot above the slot and between opposite sides of the brick engagement panel.

26. A bricklaying tool as claimed in claim 25, wherein said stiffening strut comprises a pair of arms which project upwardly from the panel at opposite sides of the slot, said arms being interconnected by a cross member.

27. A bricklaying tool as claimed in claim 25, wherein the mortar retaining flange extends along a rear edge of the brick engagement panel.

28. A bricklaying tool as claimed in claim 25, wherein the mortar retaining flange extends along a rear edge and along a side edge of the brick engagement panel.

29. A bricklaying tool as claimed in claim 25, comprising a level indicating means for indicating both a longitudinal and a transverse level of the mortar guide member.

30. A bricklaying tool as claimed in claim 25, comprising a spirit level on a first portion of the mortar retaining flange at the rear edge of the brick engagement panel and a spirit level on a second portion of the mortar retaining flange at the side edge of the brick engagement panel.

31. A bricklaying tool as claimed in claim 25, wherein the locating means comprises two spaced-apart pairs of spring loaded locator elements mounted on an underside of the brick engagement panel, each pair of locator elements for engagement with opposite side faces of a brick when the panel is mounted on top of said brick, said locator elements being resiliently moveable apart for clamping engagement with the opposite side faces of the brick.

32. A bricklaying tool as claimed in claim 25, wherein the mortar receiving slot is open at one end.

* * * * *